United States Patent [19]

Goodman

[11] 3,955,315

[45] May 11, 1976

[54] NOVELTY ARTICLE

[76] Inventor: Gregory L. Goodman, 39 Grandview Terrace, Tenafly, N.J. 07670

[22] Filed: Jan. 20, 1975

[21] Appl. No.: 542,162

[52] U.S. Cl. ..... 46/238; 272/1 R

[51] Int. Cl.[2] ..... A63H 33/26

[58] Field of Search ..... 272/1 R, 8 R, 8 D, 8 N; 273/1 M; 35/19 A; 46/236, 238, 239, 240, 241, 242, 237; 335/209, 306

[56] References Cited

UNITED STATES PATENTS

| | | | |
|---|---|---|---|
| 2,702,191 | 2/1955 | Lemelson | 46/236 X |
| 3,550,316 | 12/1970 | MacPherson | 46/238 |
| 3,609,606 | 9/1971 | Podesto | 46/238 |
| 3,864,872 | 2/1975 | Hoetzel | 46/241 |

OTHER PUBLICATIONS

Barry Toycraft, 1965 Catalog, Magic Balloon, (No. 97).

*Primary Examiner*—Richard C. Pinkham
*Assistant Examiner*—Arnold W. Kramer
*Attorney, Agent, or Firm*—Sommers & Sommers

[57] ABSTRACT

An article for use as a novelty to provide amusement and interest in the movement of magnets supported therein, which includes an upper magnet suspended by a line from the upper portion of a frame and magnetized so that opposite faces define poles of opposite polarity, and a lower magnet connected by a line to the lower portion of the frame and magnetized so that opposite faces define poles of opposite polarity, which lower magnet is oriented with respect to the upper magnet so that the poles of the upper and lower magnets which are facing each other are of opposite polarity so that the upper and lower magnets attract each other when the lower magnet is positioned proximate to the upper magnet, and which line connecting the lower magnet to the frame is of a length such that the lower magnet is restrained from contacting the upper magnet when the line is fully extended upon positioning the lower magnet proximate to the upper magnet. The magnets are both freely movable in relation to the lines to which they are secured, which lines are both freely flexible.

2 Claims, 1 Drawing Figure

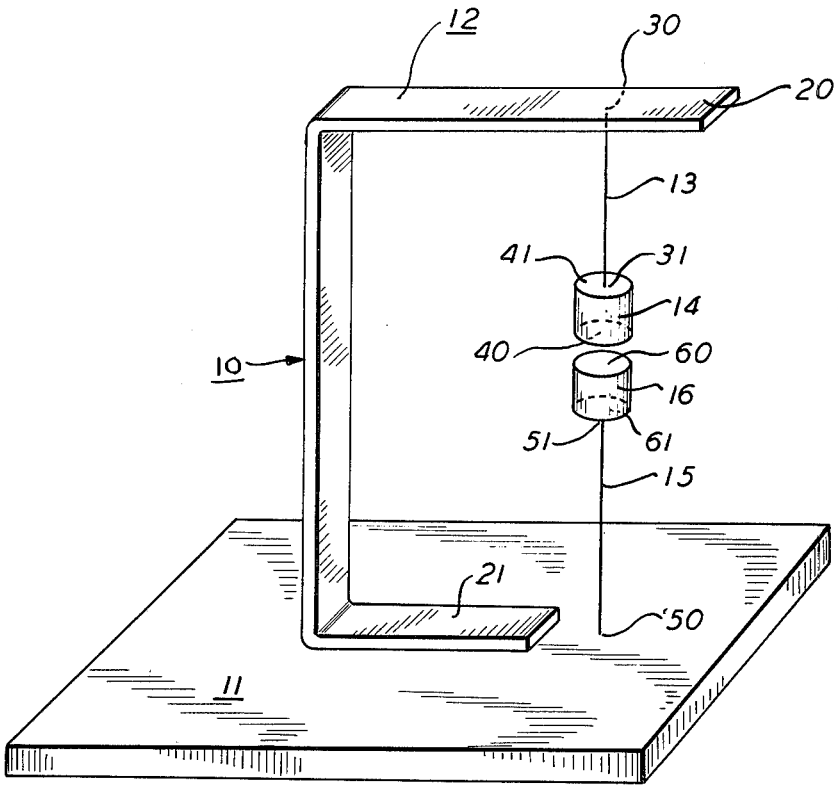
12
30
20
13
41
31
14
40
60
10
16
51
61
15
21
50
11

NOVELTY ARTICLE

BACKGROUND OF THE INVENTION

This invention relates generally to novelty devices; more specifically, this invention relates to a novelty article which includes magnets supported therein movable in fluctuating motion.

In accordance with the foregoing, it is among the objects of this invention to provide a novelty article which provides interest and amusement in the observation of the fluctuating motion of magnets therein, which motion can be enhanced by the observer by generating vibration or movement of the supporting surface on which the article is positioned.

SUMMARY OF THE INVENTION

The foregoing objects and others are achieved, in accordance with this invention, in an article which includes an upper magnet suspended by a line from the upper portion of a frame and magnetized so that opposite faces define poles of opposite polarity, and a lower magnet connected by a line to the lower portion of the frame and magnetized so that opposite faces define poles of opposite polarity, which lower magnet is oriented with respect to the upper magnet so that the poles of the upper and lower magnets which are facing each other are of opposite polarity so that the upper and lower magnets attract each other when the lower magnet is positioned proximate to the upper magnet, and which line connecting the lower magnet to the frame is of a length such that the lower magnet is restrained from contacting the upper magnet when the line is fully extended upon positioning the lower magnet proximate to the upper magnet. The magnets are both freely movable in relation to the lines to which they are secured, which lines are both freely flexible.

DESCRIPTION OF THE DRAWING

The invention is illustrated, by way of example, in the accompanying drawing wherein the FIGURE is a side perspective view of an article in accordance with the invention.

DESCRIPTION OF THE PREFERRED EMBODIMENT

In accordance with the preferred embodiment of the invention as illustrated in the FIGURE, an article 10 for use as a novelty comprises, for example, a base 11, a C-shaped frame 12 including an upper portion 20 and a lower portion 21 secured to the base 11, an upper line 13 secured at one end 30 to the upper portion 20 of the frame 12, an upper magnet 14 secured to the other end 31 of the upper line 13 and magnetized so that the opposite faces 40, 41 define poles of opposite polarity, a lower line 15 secured at one end 50 to the base 11, and a lower magnet 16 secured to the other end 51 of the lower line 16 and magnetized so that opposite faces 60, 61 define poles of opposite polarity. The upper magnet 14 and lower magnet 16 are oriented with respect to each other so that when the lower magnet 16 is lifted to a position proximate the upper magnet 14, the facing poles 40 and 60 of the upper magnet 14 and lower magnet 16 respectively are of opposite polarity such that the upper magnet 14 and the lower magnet 16 attract each other. The lower line 15 is of a length such that the lower magnet 16 is restrained thereon from contacting the upper magnet 14 when the lower line 15 is fully extended upon lifting the lower magnet 16 to position same proximate to the upper magnet 14. The magnets are both freely movable in relation to the lines to which they are secured, which lines are both freely flexible. The article 10 provides interest and amusement in the observation thereof when the base 11 and C-shaped frame 12 are supported on a suitable supporting surface, such as a desk or table top, and when the lower magnet 16 is lifted to a position proximate the upper magnet 14, whereupon the upper magnet 14 and lower magnet 16 are attracted to each other while being restrained from contacting each other, and such magnets move, in a visually interesting manner, in fluctuating motion on the ends of the upper line 13 and lower line 15, especially upon vibration or movement of the supporting surface.

In view of the foregoing disclosure, it will be understood that while this invention has been set forth in terms of specific embodiments thereof, variations may be made therein by those skilled in the art which variations are nevertheless within the scope and spirit of this invention. This invention is therefor to be broadly construed within the scope and spirit of the claims.

I claim:

1. A novelty article comprising:

a. frame means including an upper portion and a lower portion;

b. a first line secured at one end to the upper portion of the frame means;

c. a first magnet secured to the other end of the first line, and magnetized so that opposite faces define poles of opposite polarity;

d. a second line secured at one end to the lower portion of the frame means;

e. a second magnet secured to the other end of the second line, and magnetized so that opposite faces define poles of opposite polarity, in which the first and second magnets are oriented with respect to each other so that the poles of the first and second magnets which are facing each other are of opposite polarity so that the first and second magnets attract each other when the second magnet is positioned proximate to the first magnet, and in which the length of the second line is such that the second magnet is restrained from contacting the first magnet when the second line is fully extended upon positioning the second magnet proximate to the first magnet; and f. said first and second lines being freely flexible, whereby the first and second magnets are freely movable with the first and second lines to which they are secured, on moving at least one of said so freely flexible lines and magnet so secured thereto.

2. In a novelty article as recited in claim 1, said frame means being C-shaped and being substantially inflexible.

* * * * *